US007446760B2

(12) United States Patent
Takada et al.

(10) Patent No.: US 7,446,760 B2
(45) Date of Patent: Nov. 4, 2008

(54) DISPLAY DEVICE AND DRIVING METHOD FOR A DISPLAY DEVICE

(75) Inventors: Naoki Takada, Yokohama (JP); Hiroyuki Nitta, Fujisawa (JP); Nobuyuki Koganezawa, Chiba (JP); Kikuo Ono, Mobara (JP); Takashi Shoji, Chigasaki (JP)

(73) Assignees: Hitachi, Ltd., Tokyo (JP); Hitachi Displays, Ltd., Chiba (JP)

( * ) Notice: Subject to any disclaimer, the term of this patent is extended or adjusted under 35 U.S.C. 154(b) by 677 days.

(21) Appl. No.: 10/784,918

(22) Filed: Feb. 24, 2004

(65) Prior Publication Data

US 2004/0183792 A1 Sep. 23, 2004

(30) Foreign Application Priority Data

Mar. 17, 2003 (JP) ..... 2003-071194

(51) Int. Cl.
*G09G 5/00* (2006.01)
*G09G 3/36* (2006.01)

(52) U.S. Cl. ..... 345/204; 345/100

(58) Field of Classification Search ..... 345/87–102, 345/204–211

See application file for complete search history.

(56) References Cited

U.S. PATENT DOCUMENTS

| | | | | |
|---|---|---|---|---|
| 5,883,609 | A * | 3/1999 | Asada et al. | 345/100 |
| 6,181,312 | B1 * | 1/2001 | Sekine | 345/98 |
| 6,396,469 | B1 | 5/2002 | Miwa et al. | |
| 6,788,277 | B2 * | 9/2004 | Kanauchi et al. | 345/77 |
| 7,027,018 | B2 * | 4/2006 | Nitta et al. | 345/87 |
| 2002/0084959 | A1 * | 7/2002 | Park et al. | 345/87 |
| 2002/0118157 | A1 | 8/2002 | Lee et al. | |
| 2003/0058229 | A1 | 3/2003 | Kawabe et al. | |
| 2003/0090449 | A1 * | 5/2003 | Arimoto et al. | 345/87 |

FOREIGN PATENT DOCUMENTS

| | | | |
|---|---|---|---|
| JP | 8-248385 | | 9/1996 |
| JP | 9-18814 | | 1/1997 |
| JP | 2001166280 | A * | 6/2001 |

* cited by examiner

*Primary Examiner*—Amr Awad
*Assistant Examiner*—Stephen G Sherman
(74) *Attorney, Agent, or Firm*—McDermott Will & Emery LLP

(57) ABSTRACT

A scan driver selects first four rows of pixels at a time and then sequentially selects second four rows of pixels for each row in double gate driving. A data driver supplies a tone voltage corresponding to black data to the first four row of pixels at a time and then sequentially supplies a tone voltage corresponding to display data to the second four rows of pixels.

7 Claims, 8 Drawing Sheets

DISPLAY DEVICE AND DRIVING METHOD FOR A DISPLAY DEVICE

BACKGROUND OF THE INVENTION

The present invention relates to a display device and a method of driving the same implemented by combining a technique to mask video data using blanking data such as black or white data during one frame period for a display device having a hold-type luminance or brightness response characteristic with a technique to apply a plurality of times a gate signal to gate lines corresponding to pixel rows.

JP-A-9-18814, U.S. Pat. No. 6,396,469 (JP-A-11-109921), and U.S. patent Publication US2003/0058229A1 (JP-A-2003-36056) describe display devices in which black data is inserted in display data to display an image thereof on a liquid crystal display (LCD) panel. Although these conventional techniques prevent blurs in mobile pictures, there exists a feat that when the period of time to apply a tone voltage to pixels is short and/or when an associated response of pixels is not sufficient, the tone voltage is not sufficient for operation. Such a tone voltage sufficient to appropriately conduct operation is a voltage required to display desired gradations.

JP-A-8-248385 and U.S. patent Publication No. 2002/0118157A1 (JP-A-2002-258817) describe display devices in which before applying a tone voltage to a pixel row of a liquid crystal display panel according to display data from an external unit, a pre-charge voltage is applied to the pixel row. According to the prior art, although a sufficient tone voltage can be applied to the pixels, there exists a fear that a residual image or an after image appears when mobile pictures are displayed and hence a blurred mobile picture takes place.

SUMMARY OF THE INVENTION

It is therefore an object of the present invention to provide a display device and a method of driving the same in which the insufficient tone voltage and the blurred mobile picture are prevented for high picture quality.

According to the present invention, a scan driver or a scanning driver selects first n rows of pixels at a time and then sequentially selects second n rows of pixels in the unit of m rows (m is less than n) in double-gate driving. A data driver supplies a tone voltage corresponding to black data to the first n rows of pixels at a time and then sequentially supplies a tone voltage corresponding to display data to the second n rows of pixels. A control circuit outputs a clock signal (e.g., a scanning clock signal) and a scanning start signal to the scan driver. The control circuit does not generate the clock signal at an interval of n periods. The control circuit generates the scanning start signal a plurality of times at one frame period. The control circuit outputs to the data driver blanking data in place of the display data at timing at which the clock signal is not generated.

According to the present invention, the control circuit outputs to the scan driver a clock signal not generated at an interval of n periods, a first scanning enable signal to invalidate selection of pixels by the scan driver at timing at which the clock signal is not generated, and a second scanning enable signal to validate selection of pixels by the scan driver at timing at which the clock signal is not generated. The control circuit resultantly outputs to the data driver particular data such as blanking data in place of display data at timing at which the clock signal is not generated. Preferably, the control circuit outputs to the scan driver a scanning start signal having width of time equal to a period of time (e.g., eight horizontal scanning periods) once per one frame period. The width ranges from a point of timing at which the clock signal is not generated to the second next point of timing at which the clock signal is not generated.

According to the present invention, the control circuit outputs to the scan driver a clock signal not generated every n periods and a scanning start signal generated a plurality of times at one frame period. The control circuit outputs to the data driver blanking data in place of the display data at timing at the clock signal is generated immediately before the timing at which the clock signal is not generated.

According to the present invention, the control circuit outputs to the scan driver a clock signal and a scanning start signal generated a plurality of times at one frame period. The control circuit outputs to the data driver blanking data in place of display data during a last half of the period of the clock signal.

According to the present invention, by masking the display data using blanking data, the blurred mobile picture is suppressed and an event in which the tone voltage becomes insufficient in the double gate driving is advantageously suppressed. It is therefore possible to implement a display device having high picture quality.

Other objects, features and advantages of the invention will become apparent from the following description of the embodiments of the invention taken in conjunction with the accompanying drawings.

DESCRIPTION OF THE EMBODIMENTS

Figure 1:
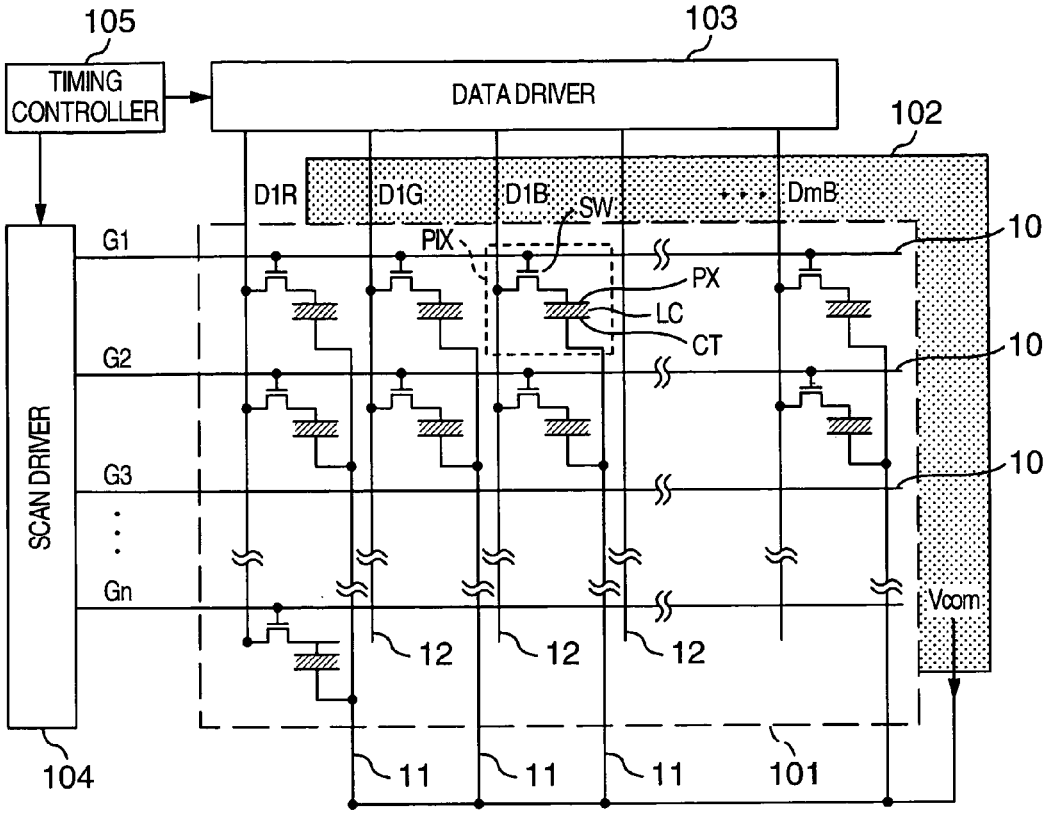
FIG. 1 is a diagram showing a configuration of a pixels array of a display device according to the present invention.

Description will now be given of embodiments by referring to a first embodiment and drawings associated therewith. In the drawings described below, the components having the same functions are assigned with the same reference numerals, and duplicated description thereof will be avoided. In the respective embodiments, the display device according to the present invention includes a liquid crystal display of normally black type by way of illustration. However, by modifying structure of pixels, the present invention is also applicable to a display device using electroluminescence of light-emitting elements such as a light-emitting diode. The present invention is also applicable to a liquid crystal display device of normally white type.

Next, the first embodiment will be described by referring to FIGS. 1 to 4.

According to an aspect of the first embodiment, double gate driving is conducted in a liquid crystal display of active matrix type and blanking data insertion is driven in the liquid crystal display having a luminance response of hold type. In the first embodiment, double gate driving is conducted for video data and single gate driving is conducted for blanking data. In liquid crystal display devices in which pictures are becoming finer today, a high-quality picture can be obtained by using these driving operations and "mobile picture blur" inherent to the display device using the hold-type luminance response can be improved. The single gate driving indicates that pixels of each row are once scanned or selected during one frame period. The double gate driving indicates that pixels of each row are scanned or selected a plurality of times, favorably, twice during one frame period.

FIG. 1 shows a configuration of a liquid crystal display of active matrix scheme.

As can be seen from FIG. 1, the configuration includes a plurality of pixels PIX arranged in a two-dimensional way or in a matrix form, pixel electrodes PX for respective pixels, and switching elements SW, for example, thin-film transistors also for respective pixels. The switching element SW supplies a video signal to the associated pixel electrode PX. An element including a plurality of pixels PIX arranged in this way is also called a pixels array 101. A pixels array in a liquid crystal display is also called a liquid crystal display panel. The pixels PIX of the pixels array form a screen to display an image thereon.

The pixels array 101 shown in FIG. 1 includes a plurality of gate lines (scanning signal lines) 10 extending in a horizontal direction and a plurality of data lines (signal lines) 12 extending in a vertical or longitudinal direction vertical to the direction of the gate lines 10. The gate lines 10 and the data lines 12 are respectively juxtaposed. Along the gate lines 10 identified by addresses G1 to Gn, pixel rows are formed with pixels PX arranged in the horizontal direction. Along the data lines 12 identified by addresses D1R, D1G, D1B, DmB, pixel columns are formed with pixels PX arranged in the vertical direction. Each gate line 10 applies from a scanning driver or a scan driving circuit) 104 a voltage signal to a switching element SW disposed in the pixels PIX of its associated pixel row (below the associated gate line in FIG. 1) to establish or release an electric connection between the pixel electrodes PX disposed for the respective pixels PIX and the respectively associated data lines 12. An operation to control a group of switching elements SW disposed for a particular pixel row by applying a voltage signal (selection signal) to an associated gate line is called selection or scanning of a line. The voltage signal applied from the scan driver 104 to the gate line 10 is called a scanning signal or a gate signal.

On the other hand, each data line 12 is applied with a voltage signal called "gray scale voltage" or "tone voltage" from a data driver (video signal driving circuit) 103. The tone voltage is applied to the pixel electrodes PX selected by the scanning signal of the pixels PIX in the associated pixel column (on the right of the associated data line). The data driver 103 is arranged on one side of the pixels array 101. Therefore, the data driver 103 can output the tone voltage only for one row at a time.

When a liquid crystal display is incorporated in a television set, for one field period of video data (video signals) received in an interlacing scheme or for one frame period of video data received in a progressive scheme, the scanning signal is sequentially applied to the gate lines G1 to Gn. A tone voltage generated from the video data received during one field or frame period is sequentially applied to a group of pixels constituting each pixel row. In each pixel, there is formed a capacity element including the pixel electrode PX and an opposing electrode to which a reference voltage or a common voltage is applied via a signal line from a common electrode 102. An electric field appearing between the pixel electrode PX and the opposing electrode CT controls optical transmittivity of a liquid crystal layer LC. As above, when the operation to sequentially select the gate lines $G_1$ to Gn is conducted once for each field or frame period of video data, the tone voltage applied, for example, to a pixel electrode PX of a pixel during a field period is logically held in the pixel electrode PX until a next tone voltage is applied thereto during a subsequent field period. Therefore, the transmittivity of the liquid crystal layer LC sandwiched between the pixel electrode PX and the opposing electrode CT (i.e., brightness of the pixel having the pixel electrode PX) is kept at a predetermined state for each field period. A liquid crystal display device which displays an image by keeping the pixel brightness for each field or frame period as above is also called "hold-type display device". The hold-type display device is discriminated form an impulse-type display device including, for example, a cathode-ray tube in which light is immediately emitted from phosphor disposed for each pixel when a video signal is received.

Figure 2:
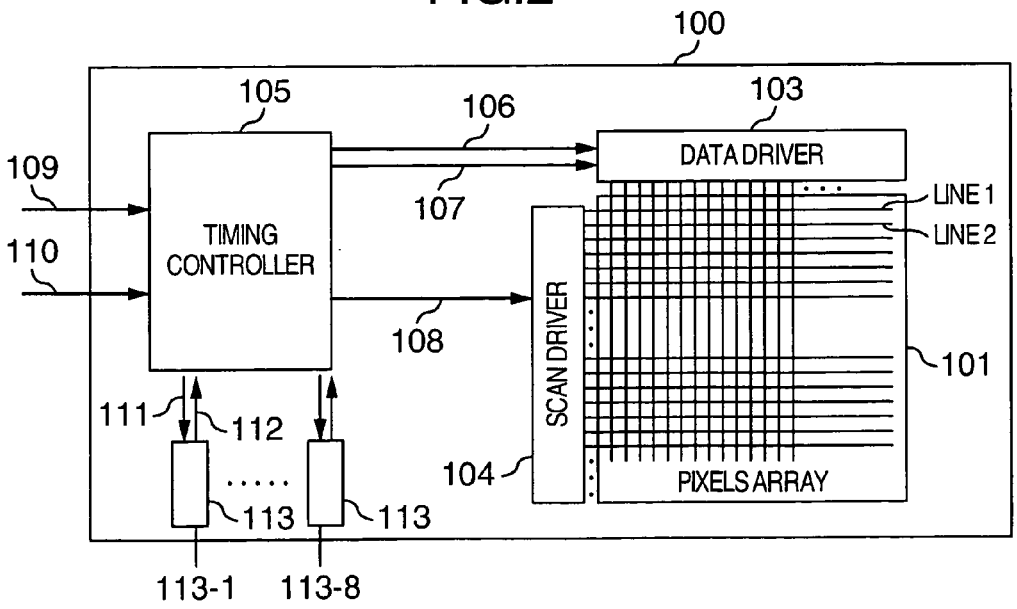
FIG. 2 is a diagram showing a configuration of a display device according to the present invention.

FIG. 2 shows a driver circuit of a liquid crystal display device in a block diagram. A data driver driving signal group 107 includes a horizontal data clock signal CL1 indicating to the data driver 103 a relationship between data items of driver data 106 and horizontal scanning periods respectively associated with the data items, a dot clock signal CL2 indicating to the data driver 103 a relationship between data items of data corresponding to the respective horizontal scanning periods and signal lines of the liquid crystal panel 101, and a polarity inversion control signal POL of an LCD control signal inputted to the data driver 103. The horizontal scanning period is a period of time of the horizontal scanning cycle. The horizontal scanning cycle is a time cycle for the scan driver 104 to select pixels, that is, a time cycle at which a gate signal is turned on. The frame period is a period of time in which an image of one screen can be displayed and is a period of time of the frame period. The frame period is a period in which the screen image is changed.

The scan driver 104 receives a scan•driver driving signal group 108. The signal group 108 includes a scanning clock CL3 to select at least one pixel row to supply a tone voltage for the horizontal scanning period, in other words, to control timing to apply a scanning signal to the gate line corresponding to each pixel row. The signal group 108 also includes scanning enable signals DISP1 and DISP2 to enable or to disable operation of applying the scanning signal to the gate line 10 corresponding to each pixel row and a scanning start signal FLM to indicate start and end points of a sequence of operations in which one screen of the pixels array is scanned using data items transferred from a display control circuit 105 for each horizontal scanning period. The scanning clock CL3 is synchronized with the horizontal data clock CL1. However, the scanning clock signal CL3 is generated during the horizontal scanning period and is not generated every nth signal (n is a positive integer equal to or more than two). The scanning start signal FLM is generated twice for one frame period (a period of time in which the pixels array 101 displays video data of one screen). The time width of signal for each scanning start signal FLM is an integer multiple (natural-number multiple) of the horizontal scanning period. Therefore, the time width of the overall scanning start signals FLM is an integer multiple (a multiple of a natural number equal to or more than two) of the horizontal scanning period.

The liquid crystal timing controller 105 includes eight memory circuits or line memories 113-1 to 113-8. Video data 109 received by the display device is written as memory write data 112 in one of these memories. Video data 109 is read from the memories as memory readout data 112 in a format suitable for reproduction of video data. The LC timing controller 105 controls, using a memory read•write control signal 111, an operation to write memory write data 112 in the memory circuit 113 and an operation to read memory readout data 112 therefrom. In the embodiment, for example, when one line of data is written in the memory 113-1, video data 109 is immediately read from the memory 113-2 in a format suitable for video data to be reproduced. Subsequently, when data of the next line is written in the memory 113-2, video data 109 is immediately read from the memory 113-3 in a format suitable for video data to be reproduced. In this way, the operation to write video data in the memory circuit 113 and the operation to read video data therefrom are repeatedly conducted for the respective memory lines. Although the embodiment includes eight memory circuits 113, the number of the memory circuits may be appropriately changed according to functions required for the display device. Suffixes (1 to 8) assigned to the reference numerals of the memory circuits are used to identify eight memory circuits connected to the display control circuit (LC timing controller) in the embodiment of the display device. It is to be understood that the reference numeric 113 without the suffix indicates the overall memory circuit unit. The LC timing controller 105 keeps blanking data in advance (according to initial setup) and outputs the blanking data at predetermined timing. Favorably, the timing controller 105 keeps the blanking data in a read-only memory (ROM) in advance.

Figure 3:
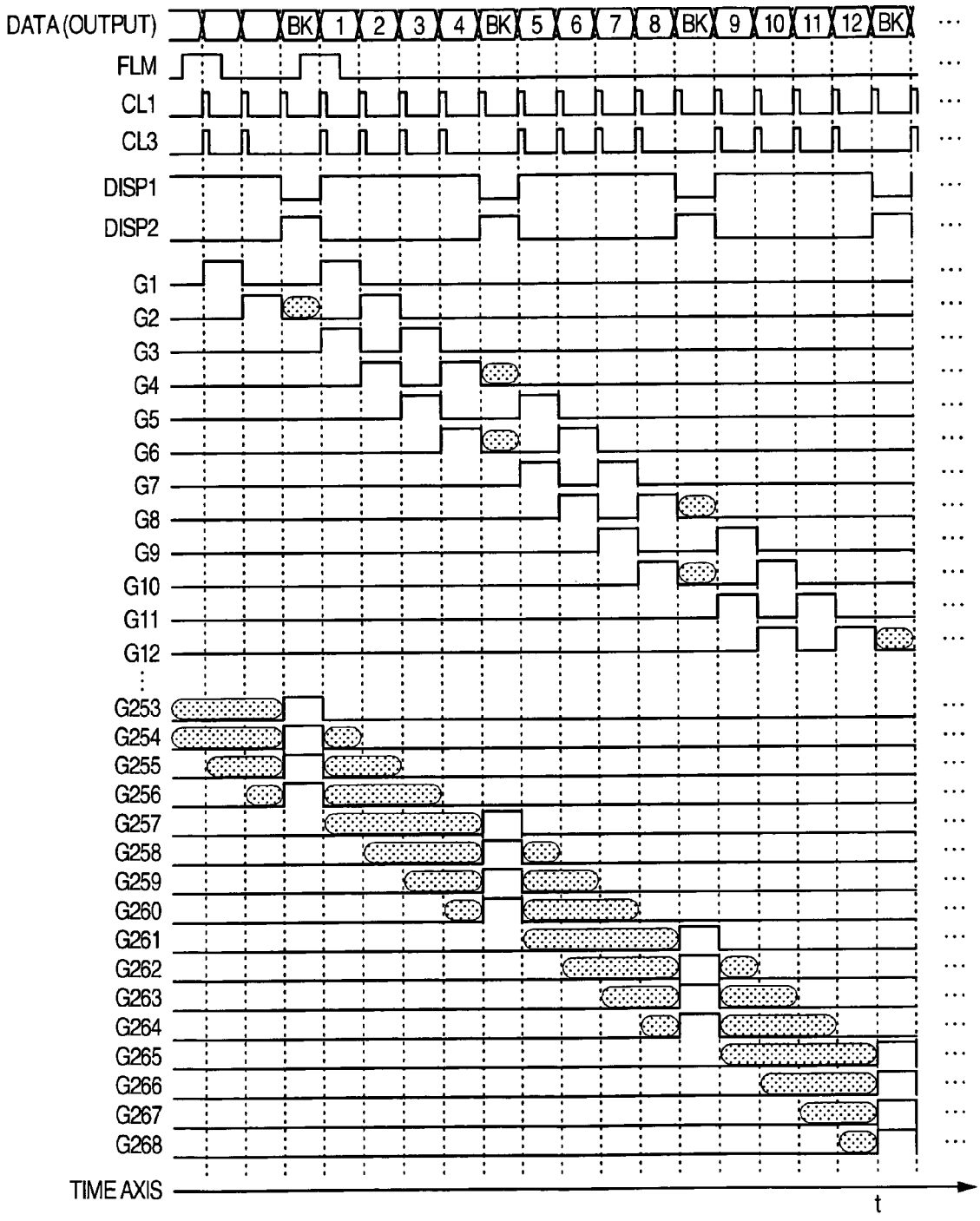
FIG. 3 is a signal timing chart of a first embodiment of a display device according to the present invention in which black insertion is conducted at an interval of five horizontal periods and gate double pulse driving is conducted using one-by-one dot inversion driving.

FIG. 3 is a signal timing chart showing waveforms of input signals to and output signals from an LC display control circuit block and gate signals on respective gate lines.

Video data 109 inputted to the LC display block 100 is read from the memory circuit 113 according to the period of the horizontal data clock signal CL1. As can be seen from FIG. 3, video data (output) fed to the LC display device are divided into video data items 1, 2, 3, 4, . . . and black data BK as blanking data for each horizontal scanning period. The blanking data may be other than black data, for example, data for the data driver 103 to produce a relatively lower tone voltage or a lowest tone voltage among the tone voltages which can be produced by the data driver 103, that is, data for the pixels array 101 to obtain relatively lower brightness or lowest brightness. The blanking data of a normally-white LC display device is favorably white data.

The gate signals of the gate lines G1, G2, G3, . . . of FIG. 3 are controlled by the scanning start signal FLM, the scanning clock signal CL3, and the scanning enable signals DISP1 and DISP2. In the one-by-one dot inversion driving shown in FIG. 3 of the embodiment, double gate driving is conducted only for the video data, and only a normal gate voltage signal is inserted in the blanking data. In the double gate driving, the first one of two scanning start signals FLM to generate a first gate voltage signal to precharge each pixel row is produced at timing two periods of the scanning clock signal CL3 before the second one of two scanning start signals FLM to generate a normal gate voltage signal in each pixel row. That is, the first scanning start signal FLM is generated at timing two horizontal scanning periods before the second scanning start signals FLM excepting one horizontal scanning period in which a tone voltage signal of the black data BK is applied. The gate line to be scanned is shifted at a period of the scanning clock signal CL3. The gate line scanning timing is determined only when the scanning enable signal DISP1 is valid. The precharge gate voltage may be substantially equal to the normal gate voltage or may be lower than the normal gate voltage.

For example, when the first scanning start signal FLM is received in FIG. 3, a data signal is produced on the data line G1 for one horizontal scanning period according to the period of the scanning clock CL3. At this point, DISP1 is in the valid state. When the first gate signal is applied, the precharge is conducted and hence the data signal are equal in polarity to the normal tone voltage. The normal tone voltage is a tone voltage corresponding to display data. After this horizontal scanning period, gate line selection is shifted from the gate line G1 to the gate line G2 in response to the scanning clock signal CL3. Two horizontal scanning periods lapse from when the gate line selection is changed from the gate line G1 to the gate line G2 to when the gate line selection is subsequently changed to the gate line G3. During this period of time, a gate signal is generated during the first horizontal scanning period and a gate signal is not generated during the second horizontal scanning period under control of the scanning enable signal DISP1. During the horizontal scanning period in which a gate signal is not generated on the gate line G2, a gate signal is generated on the gate lines G253 to G256 under control of the scanning enable signal DISP2. To four gate lines on which a gate signal is generated, the data driver applies as a data signal a tone voltage of black data BK. Next, the gate line selection is shifted from the gate line G2 to the gate line G3 in response to the scanning clock CL3 and a gate signal is generated on the gate line G3 for one horizontal scanning period. In this way, the first gate signal to conduct precharge in the double gate driving is generated under control of the scanning enable signal DISP1 by sequentially changing the gate line selection as G1, G2, G3, . . . at timing synchronized with the scanning clock signal CL3. The polarity of data applied to a pixel row corresponding to the gate line on which the first gate signal is applied for the precharge in the double gate driving is substantially equal to that of the second gate signal voltage to apply the normal tone voltage. At an intermediate point, namely, during the horizontal scanning period in which a gate signal is not generated under control of the scanning enable signal DISP1, a data signal of black data BK is applied to four gate lines selected under control of the scanning enable signal DISP2.

Next, when the second scanning start signal is received in FIG. 3, a data signal is similarly generated on the data line G1 for one horizontal scanning period according to the period of the scanning clock signal CL3. At this point, the signal DISP1 is in the valid state. After this horizontal scanning period, the gate line selection is shifted from the gate line G1 to the gate line G2 in response to the scanning clock signal CL3. According to the period of the scanning clock CL3, the gate line selection is sequentially shifted from G2 to G3, G3 to G4, and so on. Also in this case, DISP1 is in the valid state. When the second gate signal is generated for each gate line and the gate line selection is sequentially shifted, the memory circuit 113 sequentially sends video data 1, 2, 3, 4, . . . for each horizontal scanning period. Numerals assigned to video data 1, 2, 3, 4, . . . correspond to line numbers sequentially assigned to the lines. One is assigned to the first line. Therefore, tone voltages from video data items 1, 2, 3, and 4 are applied to pixels PIX in pixel rows corresponding to the gate lines G1, G2, G3, and G4.

Two horizontal scanning periods lapse from when the gate line selection is changed from the gate line G3 to the gate line G4 to when the gate line selection is next changed to the gate line G5. During this period of time, a control operation is conducted almost in the same way as for the creation of the first gate signal in the double gate driving. A gate signal is generated during the first horizontal scanning period and a gate signal is not generated during the second horizontal scanning period under control of the scanning enable signal DISP1. During the horizontal scanning period in which a gate signal is not generated on the gate line G2, a gate signal is generated on the gate lines G257 to G260 under control of the scanning enable signal DISP2. To four gate lines on which a gate signal is generated, a tone voltage of black data BK is applied as blanking data. A second gate signal to apply a normal tone voltage of double gate driving to each line is generated under control of the scanning enable signal DISP1 by sequentially shifting gate line selection as G1, G2, G3, . . . at timing synchronized with the scanning clock CL3. Data signals on the data lines respectively for the video data items 1, 2, 3, 4, . . . are sequentially applied to pixels PIX in the pixel rows corresponding to the gate lines G1, G2, G3, . . . , respectively. At an intermediate point, namely, during the period in which a gate signal is not generated under control of DISP1, a data signal of black data BK is applied to the pixels array 101 via four gate lines selected under control of DISP2. That is, a tone voltage corresponding to black data BK is supplied to four pixel rows at a time, and then a tone voltage corresponding to display data is sequentially supplied to the pixel rows. In the example of FIG. 3, the data signal of black data BK is applied to the pixels array 101 during one horizontal scanning period immediately after the precharge or immediately after the normal charge.

Figure 4:
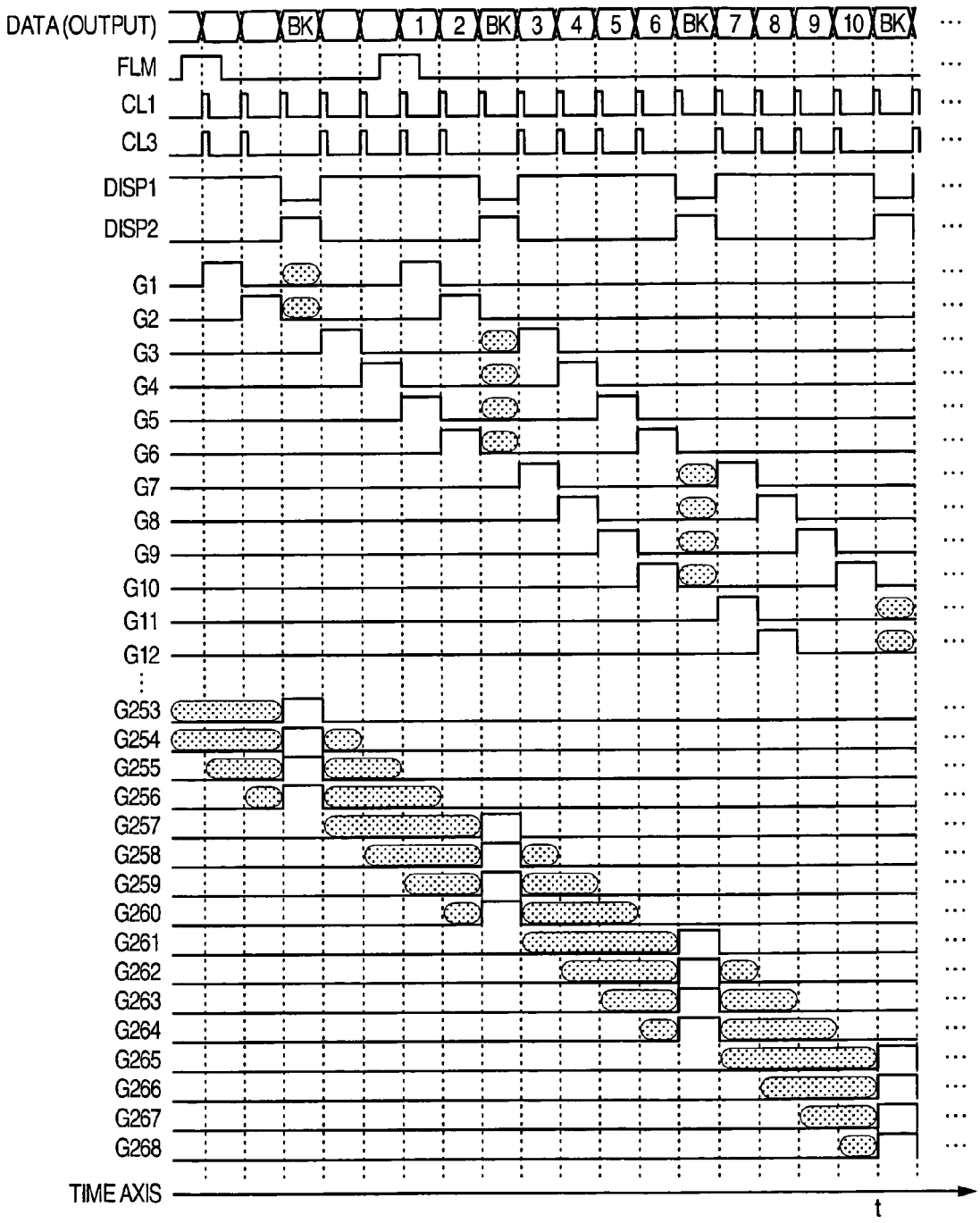
FIG. 4 is a signal timing chart of the first embodiment of the display device according to the present invention in which black insertion is conducted at an interval of five horizontal periods and gate double pulse driving is conducted using one-by-two dot inversion driving.

The gate signals of the gate lines G1, G2, G3, . . . of FIG. 4 are controlled by the scanning start signal FLM, the scanning clock signal CL3, and the scanning enable signals DISP1 and DISP2. In the one-by-two dot inversion driving shown in FIG. 4, double gate driving is conducted only for the video data, and only a normal gate voltage signal is inserted in the blanking data. In the double gate driving, the first one of two scanning start signals FLM to generate a first gate voltage signal to precharge each pixel row is produced at timing four periods of the scanning clock signals CL3 before the second one of two scanning start signals FLM to generate a normal gate voltage signal in each pixel row. That is, the first scanning start signal FLM is generated at timing four horizontal scanning periods before the second scanning start signals FLM excepting one horizontal scanning period in which a tone voltage signal of the black data BK is applied. The gate line to be scanned is shifted at a period of the scanning clock CL3. The gate line scanning timing is determined only when the scanning enable signal DISP1 is valid. The control operation of FIG. 4 is substantially the same as that of FIG. 3. Since only the scanning start signal FLM varies therebetween, description of operations in FIG. 4 will be avoided. In the example of FIG. 4, the data signal of black data BK is applied to the pixels array 101 during one horizontal scanning period between the precharge and the normal charge.

By the control operation using the scanning start signal FLM, the scanning clock signal CL3, and the scanning enable signals DISP1 and DISP2 in the scanning of pixel rows corresponding to the gate lines, double pulse driving is conducted for video data as above. This resultantly improves a charging rate of the pixel electrodes in the associated pixels PIX. Since blanking data is inserted in the video data, the mobile picture blur often taking place in a hold-type luminance response can be improved. In the first embodiment, double gate driving and blanking data insertion can be conducted during one frame period.

Next, a second embodiment will be described by referring to FIGS. 1, 2, and 5.

The liquid crystal display device of the second embodiment is almost the same as that of FIG. 1 and hence description of the video display principle of the display device will be avoided. The block diagram of a control circuit of the LC display device of the second embodiment is substantially the same as that of FIG. 2 and hence detailed description thereof will be avoided.

According to an aspect of the second embodiment, double gate driving is conducted also for the blanking data for which single gate driving is conducted in the first embodiment. Thanks to the driving method of the second embodiment, there can be obtained the advantage of the first embodiment and an advantage of improving the mobile picture blur inherent to a display device using the hold-type luminance response.

Figure 5:
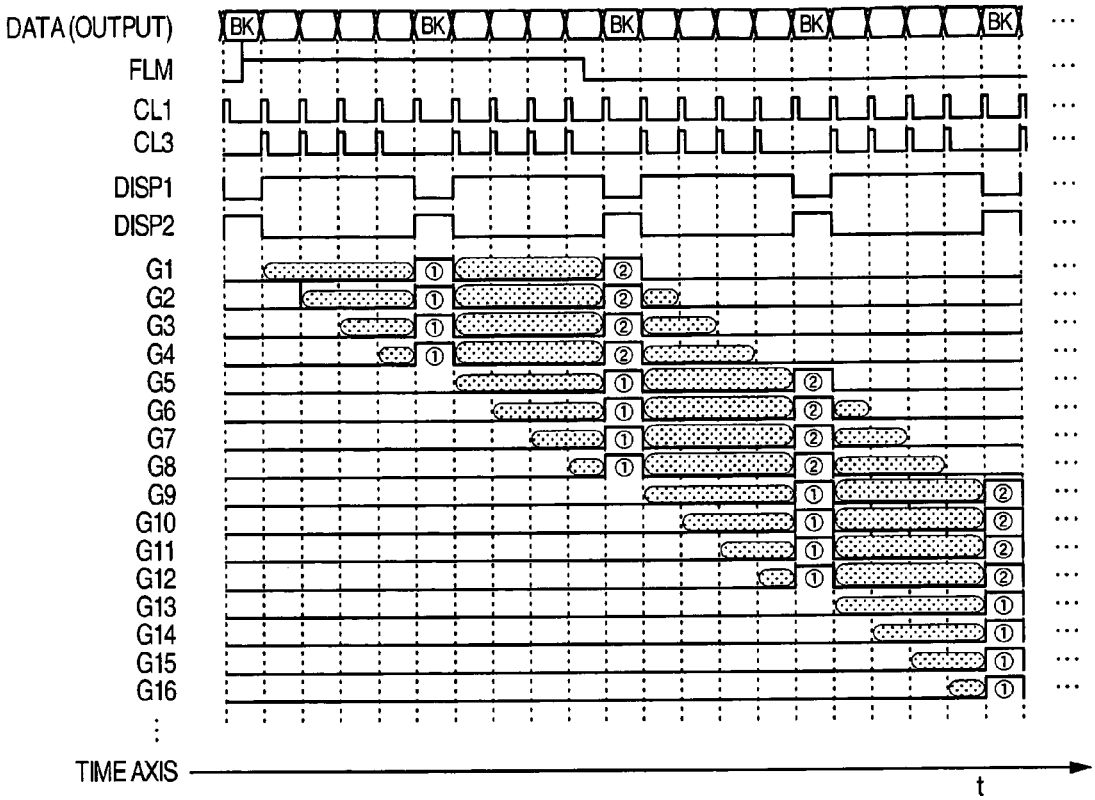
FIG. 5 is a signal timing chart of a second embodiment of the display device according to the present invention in which gate double pulse driving is conducted for black data to be inserted.

FIG. 5 is a timing chart showing waveforms of input signals to and output signals from the LC display control circuit block and gate signals on respective gate lines.

Video data 109 inputted to the LC display block 100 is read from the memory circuit 113 at the period of the horizontal data clock CL1. Also in FIG. 5 as in FIG. 3, video data (output) fed to the pixels array of the LC display device are divided into video data items 1, 2, 3, 4, . . . and black data BK as blanking data for each horizontal scanning period. The gate signals for the gate lines G1, G2, G3, . . . are controlled by the scanning start signal FLM, the scanning clock signal CL3, and the scanning enable signals DISP1 and DISP2.

The double gate driving for video data is conducted in a control operation almost same as that of the first embodiment and hence description of the driving in the second embodiment will be avoided.

In the double gate driving for the blanking data, the scanning start signal FLM generated in the display device has a length of eight horizontal scanning periods. Therefore, during a period to select the first gate line G1, there exist eight periods of the scanning clock signal CL3, i.e., ten horizontal scanning periods. On the other hand, at every fifth horizontal scanning period, the scanning enable signal DISP2 creates a scanning enable period having a length of one horizontal period. Therefore, two gate signals are created on the gate line G1 according to the period in which the gate line selection period of G1 and the period in which the scanning enable signal DISP2 becomes valid.

For example, when the scanning start signal FLM has a length of eight horizontal scanning periods as shown in FIG. 5, eight periods of the scanning clock signal CL, i.e., ten horizontal scanning periods exist in the selection period of the gate line G1. During ten horizontal scanning periods thus selected, two gate signals are created on the gate line G1 with an interval of four horizontal scanning periods therebetween under control of the scanning enable signal DISP2 (FIG. 5). After the gate line G1 is selected, the gate line selection is sequentially shifted as G2, G3, G4, . . . for each scanning clock signal CL3. Similarly, two gate signals are generated on each gate line with an interval of four horizontal scanning periods therebetween in the same way as for the gate line G1 (FIG. 5). The data driver applies a tone voltage of black data BK as blanking data to the pixels PIX in the pixel rows selected by two gate signals generated on each gate line.

By conducting the double gate driving for the video data and the blanking data as above, the charging rate is improved for the black data on each pixel row.

Next, a third embodiment will be described by referring to FIGS. 1, 2, 6, 7, and 8.

Since the liquid crystal display device of the third embodiment is almost the same as that of FIG. 1, description of the video display principle of the display device will be avoided. Similarly, the block diagram of a control circuit of the LC display device of the third embodiment is almost the same as that of FIG. 2. Therefore, detailed description thereof will be avoided.

Figure 6:
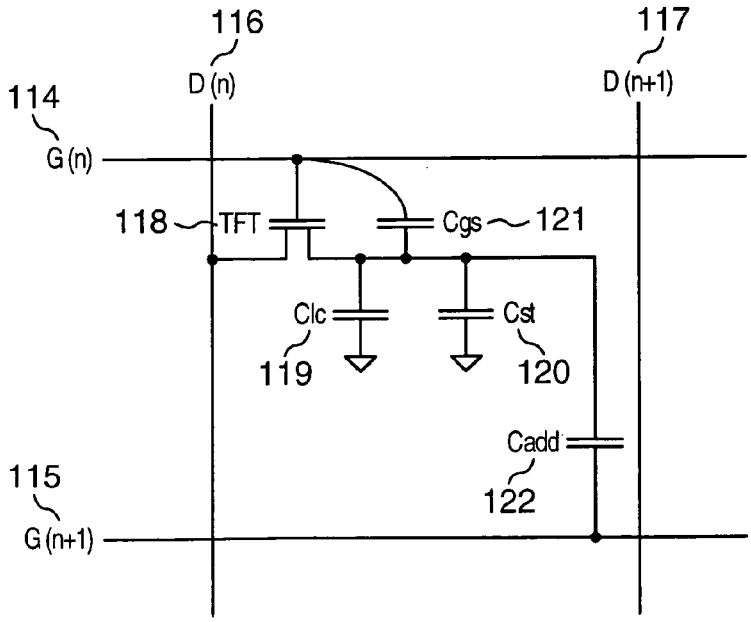
FIG. 6 is a diagram showing a configuration of a pixel to cancel a jump voltage and a rewrite voltage for a data signal due to Cgs.

The operation of the data driver to write a tone voltage of video data or blanking data in each pixel PIX is conducted during a period of time in which the gate signal is being generated in each associated gate line. After a gate signal is generated on a gate line on which video data is to be written, a jump voltage and a rewrite voltage fluctuate due to a gate wave delay at a falling edge of the gate signal. FIG. 6 shows a configuration of a pixel in which a jump voltage due to Cgs caused by a characteristic of a switching element (e.g., a thin-film transistor) is cancelled using Cadd to reduce the absolute value of the jump voltage. This resultantly reduces the fluctuation in the jump voltage and the rewrite voltage to improve the lateral or horizontal luminance inclination.

When compared with the first embodiment, the third embodiment has an aspect of employing Cadd,Cgs cancelation driving. Therefore, the third embodiment has an advantage of improving the lateral luminance inclination in addition to the advantage of the first embodiment.

To conduct the Cadd,Cgs cancelation driving, it is required that a falling edge of the gate signal on a gate line G(n) matches in timing with a rising edge of the gate signal on a gate line G(n+1).

Figure 7:
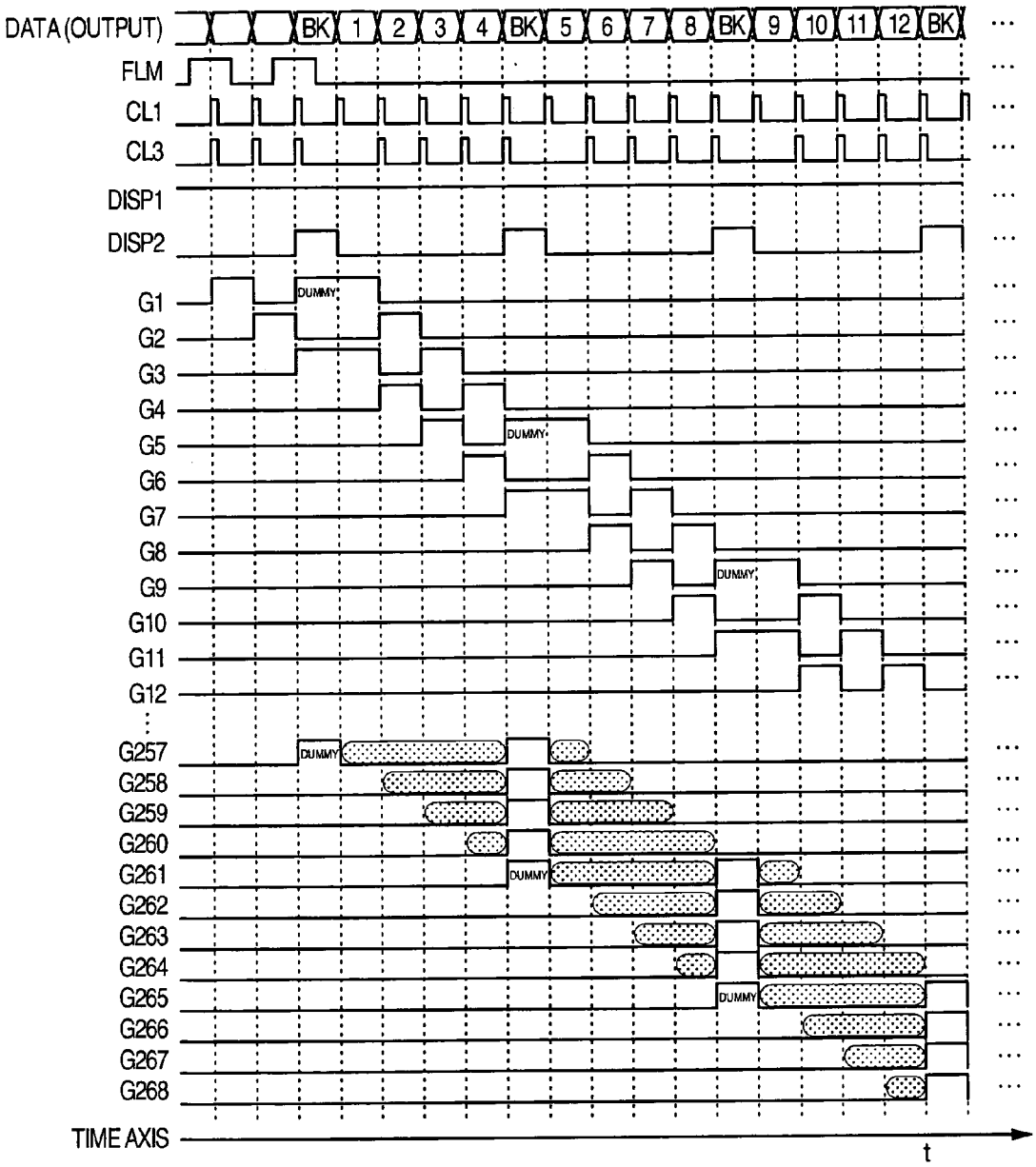
FIG. 7 is a signal timing chart of a third embodiment of the display device according to the present invention in which a gate signal with a generated dummy signal is shifted and the gate double pulse driving is conducted using one-by-one dot inversion driving.

FIG. 7 is a signal timing chart of waveforms of input signals to and output signals from the LC display control circuit block and gate signals on respective gate lines when the Cadd,Cgs cancelation driving is conducted in addition to the driving method of the one-by-one dot inversion driving of the first embodiment.

Paying attention, for example, to a second gate signal of two gate signals generated on each gate line to apply a normal tone voltage, control is achieved such that a falling edge of the gate signal on the gate line G4 matches in timing with a rising edge of the gate signal on the gate line G5 or a falling edge of the gate signal on the gate line G8 matches in timing with a rising edge of the gate signal on the gate line G9. That is, between the gate lines G4 and G5 to shift the gate signal at timing before and after a write operation of black data BK as blanking data, control is conducted such that the falling edge of the gate signal on the gate line G4 immediately before the black data write operation matches in timing with the rising edge of the gate signal on the gate line G5 immediately after the black data write operation. Or, control is similarly conducted also for the shift operation between the gate lines G8 and G9. For this purpose, a dummy signal is generated at timing of the falling of the gate signal on the gate line G4 immediately before the black data write operation so that the gate signal on the gate signal line G5 rises immediately after the black data write operation. Or, control is similarly conducted also for the operation between the gate lines G8 and G9. As a result, the gate signal is generated for two horizontal scanning periods on the gate line G5 or G9 immediately after the black data write operation. On the gate line 5 or 9 on which the dummy signal is generated in the gate signal, a tone voltage of the black data BK is applied as a data signal sent from the data driver during one horizontal scanning period of the dummy signal. During the other horizontal scanning period in which a normal tone voltage is applied, a tone voltage of the video data is applied as a data signal sent from the data driver. Therefore, the black data is scanned once during the horizontal scanning period of the dummy signal. However, it can be considered that the visual sense of a human does not perceive such a change in quite a short period of time, and hence the change rarely causes any adverse effect.

According to substantially the same control operation as for the first embodiment, four gate lines G257 to G260 or G261 to G264 are simultaneously selected and the gate signal is applied to the respective gate lines at timing when the black data BK as blanking data is written. Control is conducted for the last gate line G260 or G264 and its subsequent gate line G261 or G265 of the gate line groups. That is, for the operation between the gate lines G260 and G261, a dummy signal is generated on the gate line G261 so that the falling edge of the gate signal on the gate line G260 matches in timing with the rising edge of the gate signal on the gate line 261. Or, control is similarly conducted also for to the operation between the gate lines G264 and G265. Resultantly, of the groups of four gate lines simultaneously selected as above, the jump voltage caused by Cgs is canceled using Cadd between the gate lines G260 and G261 or between the gate lines G264 and G265 to reduce the absolute value of the jump voltage. This resultantly reduces the fluctuation in the jump voltage and the rewrite voltage to improve the lateral luminance inclination. Between the gate line G261 and its subsequent gate line G262 or between the gate line G265 and its subsequent gate line G266, the jump voltage caused by Cgs is not canceled using Cadd. Therefore, the fluctuation in the jump voltage and the rewrite voltage is not reduced and hence the lateral luminance inclination takes place. However, Between the gate lines G261 and G262 or between the gate lines G265 and G266, four gate lines including the lines G261 and G262 or the lines G265 and G266 are simultaneously selected and a gate signal is applied thereto after lapse of four horizontal scanning periods. Therefore, the lateral luminance inclination is canceled.

Figure 8:
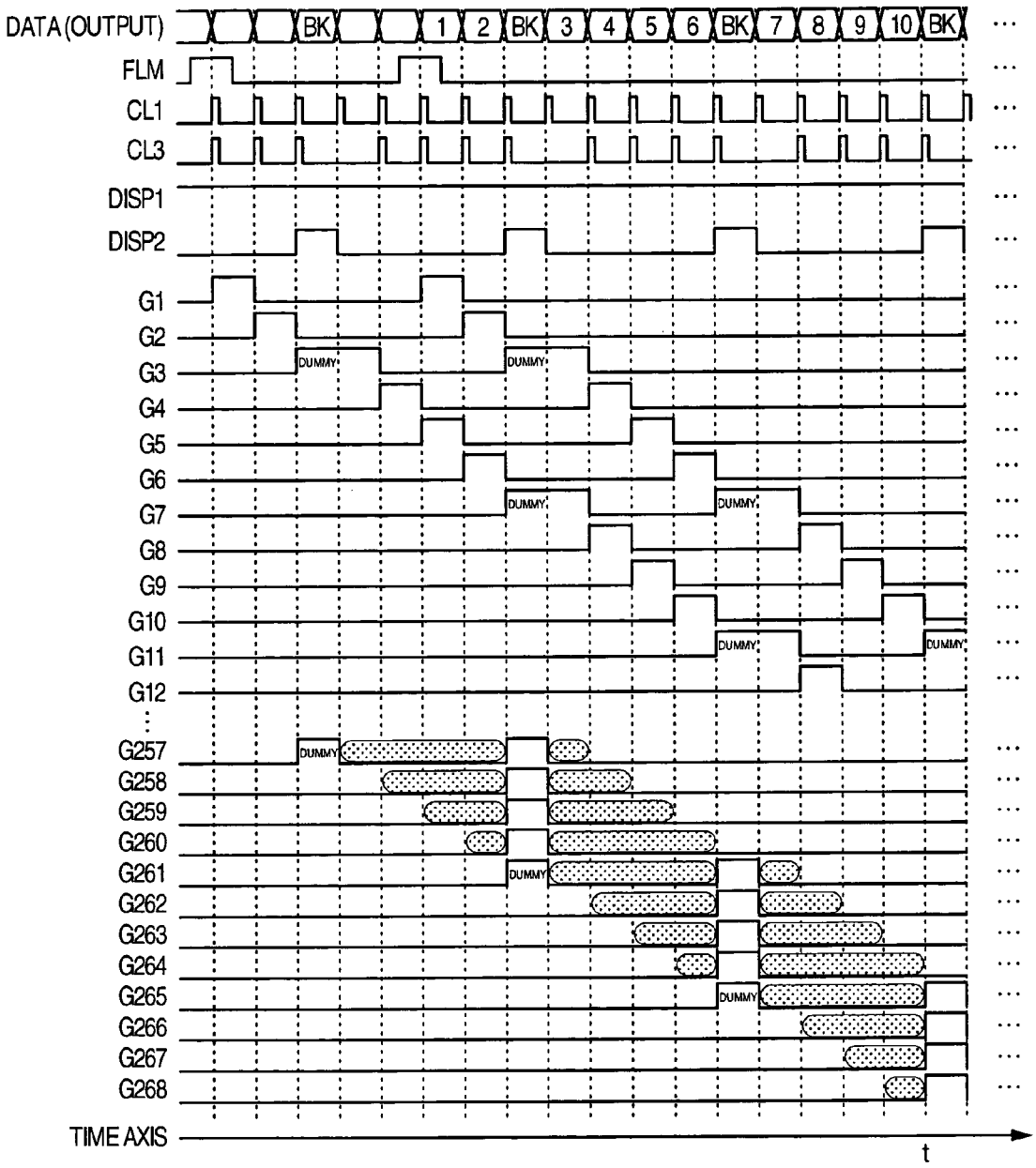
FIG. 8 is a signal timing chart of a third embodiment of the liquid crystal display device according to the present invention in which a gate signal with a generated dummy signal is shifted and the gate double pulse driving is conducted using one-by-two dot inversion driving.

FIG. 8 is a signal timing chart showing waveforms of input signals to and output signals from the LC display control circuit block and gate signals on respective gate lines when the Cadd,Cgs cancelation driving is conducted in addition to the driving method of the one-by-two dot inversion driving of the first embodiment.

Control of FIG. 8 is substantially equal to that of FIG. 7. Discrepancy therebetween resides only in the scanning start signal FLM. Therefore, description of events in FIG. 8 will be avoided.

As above, a dummy signal is created so that the falling edge of the gate signal generated on the gate line G(n) matches in timing with the rising edge of the gate signal on the gate line G(n+1). Thanks to the control described above, the horizontal luminance inclination is improved in addition to the advantage of the first embodiment, it is possible to increase picture quality of the liquid crystal display device.

Referring now to FIGS. 1, 2, 9, and 10, description will be given of a fourth embodiment.

The liquid crystal display device of the fourth embodiment is almost the same as that of FIG. 1, and hence description of the video display principle of the display device will be avoided. Also, the block diagram of a control circuit of the LC display device of the fourth embodiment is almost the same as that of FIG. 2. Therefore, detailed description thereof will be avoided.

While the ratio between the hold time of the tone voltage of video data to that of the tone signal of black data BK as blanking data is three to one for one frame period in the first to third embodiments, the ratio is set to one to one according to an aspect of the fourth embodiment. When compared with the first to third embodiments, the hold time of blanking data is longer as a result of such a driving operation in the fourth embodiment, and hence the response characteristic of the display device becomes more similar to an impulse-type luminance response characteristic. Therefore, the mobile picture blur appearing in a hold-type display device can be much more improved.

Figure 9:
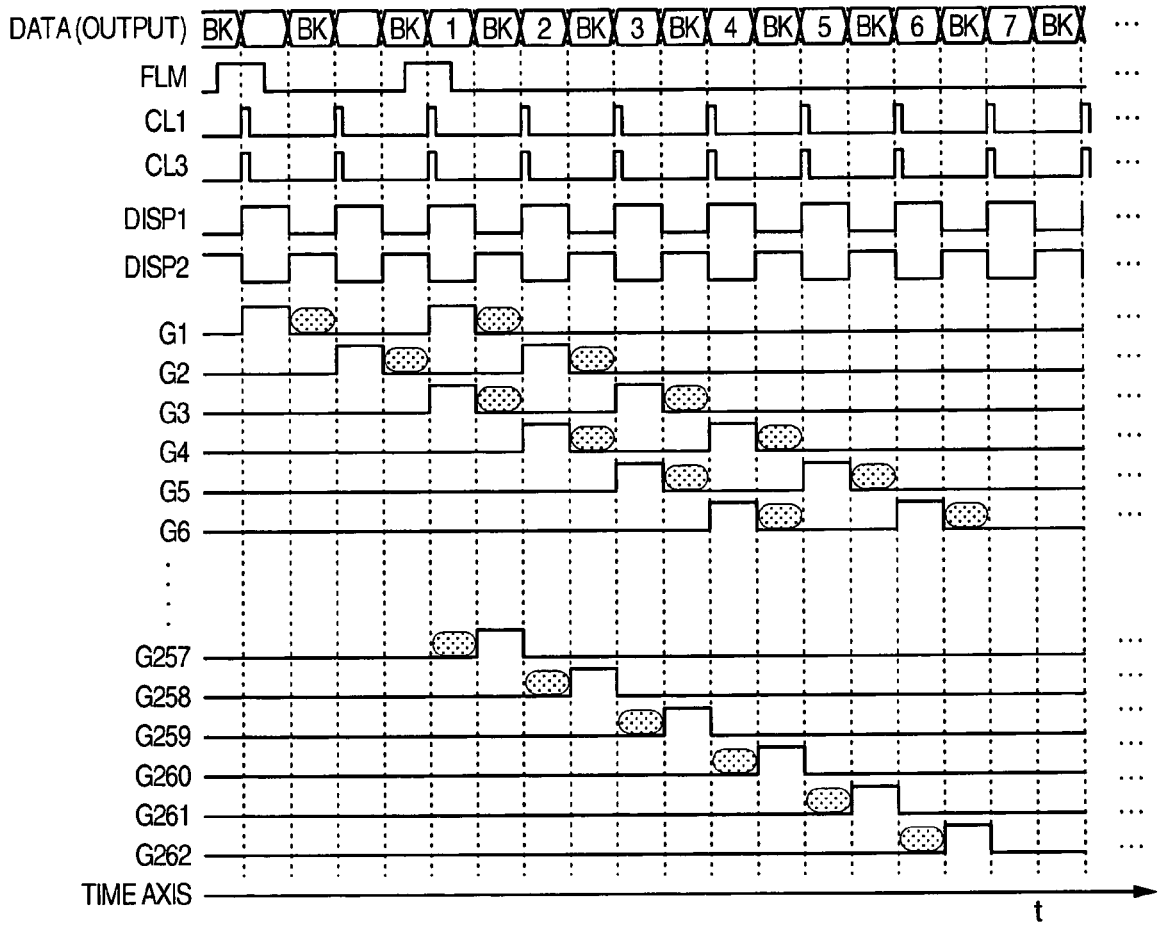
FIG. 9 is a signal timing chart of a fourth embodiment of the liquid crystal display device according to the present invention in which the black insertion is conducted at timing once per horizontal period and the gate double pulse driving is conducted using one-by-one dot inversion driving.

FIG. 9 is a signal timing chart showing waveforms of input signals to and output signals from the liquid crystal display control circuit block and gate signals on respective gate lines.

The gate signals of the gate lines G1, G2, G3, . . . of FIG. 9 are controlled by the scanning start signal FLM, the scanning clock signal CL3, and the scanning enable signals DISP1 and DISP2. In the one-by-one dot inversion driving shown in FIG. 9 of the embodiment, double gate driving is conducted only for the video data, and only a normal gate voltage signal is inserted in the blanking data. In the double gate driving, the first one of two scanning start signals FLM to generate a first gate voltage signal to precharge each pixel row is produced at timing two periods of the scanning clock signal CL3 before the second one of two scanning start signals FLM to generate a normal gate voltage signal in each pixel row. The gate signal generated on the gate line by the scanning start signal FLM is shifted at a period of the scanning clock signal CL3. The gate signal is generated only when the scanning enable signal DISP1 is valid. The scanning enable signal DISP1 is valid during a first half of one horizontal scanning period to invalidate a second half of the horizontal scanning period. When the scanning enable signal DISP1 is valid during the first half of the horizontal scanning period, the scanning enable signal DISP2 is invalid. When the signal DISP1 is invalid during the second half of the horizontal scanning period, the scanning enable signal DISP2 is valid. Therefore, the gate signal on each gate line is shifted at a period of the scanning clock signal CL3. The signal is created during the first half of the horizontal scanning period. Blank data BK as blanking data exists in the second half of the horizontal scanning period.

For example, when the first or second scanning start signal FLM is received in FIG. 9, a data signal is produced on the data line G1 in a half of one horizontal scanning period according to the period of the scanning clock CL3. At this point, DISP1 is in the valid state in the first half of the horizontal scanning period. When the first and second gate signal are applied, the data signal polarity is set such that the tone voltage of the precharge is equal in polarity to the normal tone voltage. After two horizontal scanning periods lapse for two gate signals on the gate line G1, gate line selection is shifted from the gate line G1 to the gate line G2 in response to the scanning clock signal CL3. During the second half of the horizontal scanning period in which a gate signal is not generated on the gate line G1 under control of the scanning enable signal DIS21, a gate signal is generated on the gate line G257 under control of the scanning enable signal DISP2. The data driver applies a tone voltage of black data BK as a data signal to the gate line G257. In this way, the first gate signal to conduct precharge and the second gate signal voltage to apply the normal tone voltage in the double gate driving are generated in the first half of the horizontal scanning period under control of the scanning enable signal DISP1 by sequentially shifting the gate line selection as G1, G2, G3, . . . at timing synchronized with the scanning clock signal CL3. During the second half of the horizontal scanning period in which a gate signal is not generated under control of the scanning enable signal DISP1, a data signal as a tone voltage of black data BK is applied under control of the signal DISP2 to the gate lines G258, G259, G260, G261, . . . by sequentially shifting the data line selection.

Figure 10:
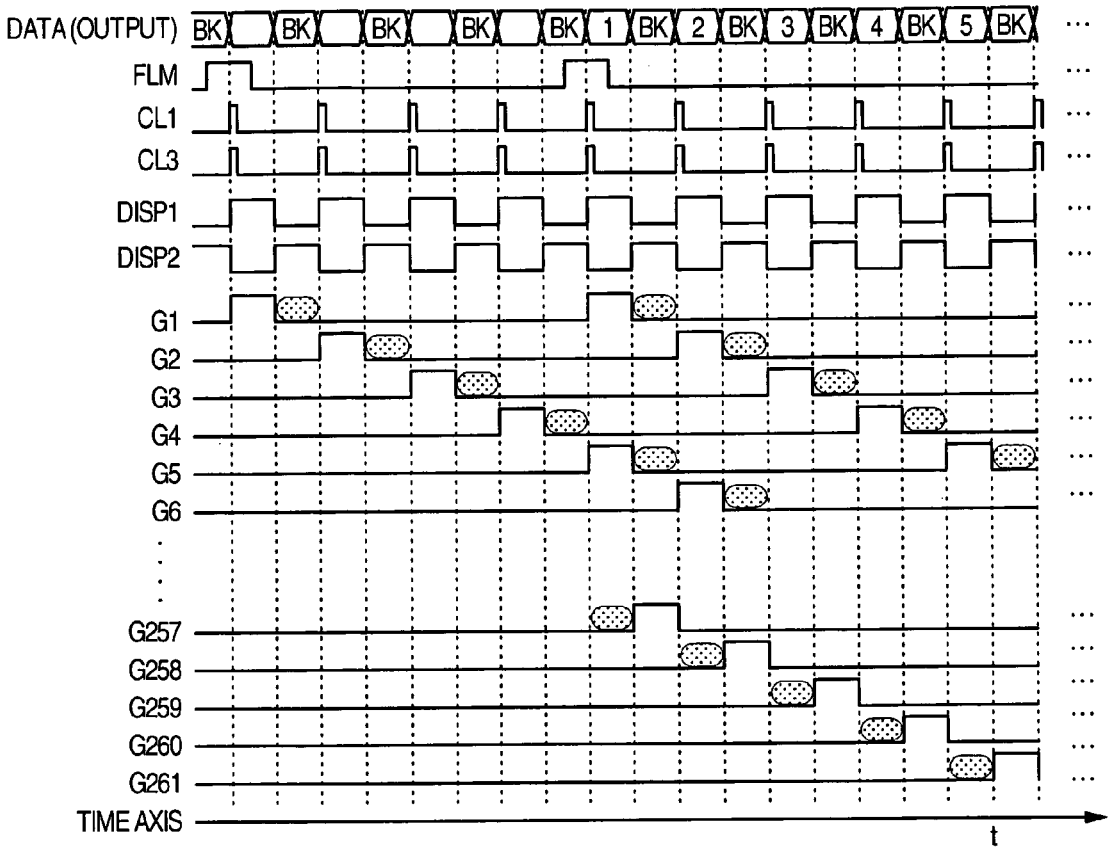
FIG. 10 is a signal timing chart of the fourth embodiment of the liquid crystal display device according to the present invention in which the black insertion is conducted at timing once per horizontal period and the gate double pulse driving is conducted using one-by-two dot inversion driving.

In the signal timing chart of the embodiment shown in FIG. 10, double gate driving is conducted only for the video data, and only a normal gate voltage signal is inserted in the blanking data in the one-by-two dot inversion driving. In the double gate driving, the first one of two scanning start signals FLM to generate a first gate voltage signal to precharge each pixel row is produced at timing four periods of the scanning clock CL3 before the second one of two scanning start signals FLM to generate a normal gate voltage signal in each pixel row. The gate signal generated on the gate line by the scanning start signal FLM is shifted at a period of the scanning clock signal CL3. The gate signal is generated only when the scanning enable signal DISP1 is valid. The scanning enable signal DISP1 is valid during a first half of one horizontal scanning period to invalidate a second half of the horizontal scanning period. When the scanning enable signal DISP1 is valid during the first half of the horizontal scanning period, the scanning enable signal DISP2 is invalid. When the signal DISP1 is invalid during the second half of the horizontal scanning period, the scanning enable signal DISP2 is valid. Therefore, the gate signal on each gate line is shifted at a period of the scanning clock signal CL3. The signal is created during the first half of the horizontal scanning period. Blank data BK as blanking data exists in the second half of the horizontal scanning period.

The control operation of FIG. 10 is substantially equal to that of FIG. 9. Discrepancy therebetween resides only in the scanning start signal FLM. Therefore, description of operations in FIG. 10 will be avoided.

As above, one half of one horizontal scanning period is used to generate a gate signal of a tone voltage of video data and the other half of one horizontal scanning period is used to generate a gate signal of a tone voltage of black data BK as blanking data. In the display device set as above, the ratio between the hold time of the tone voltage of video data applied to the pixel electrode of each pixel PIX and the hold time of the tone voltage of black data BK as blanking data is set to one to one for one frame period and the double gate driving is conducted.

According to the present invention, by masking the video data inputted to the liquid crystal display device during one frame period, the hold-type luminance response characteristic of the device can be modified to be similar to the impulse-type luminance response characteristic. By applying a gate signal a plurality of times to the gate lines corresponding to the respective pixel rows, the pixel capacity element of each associated pixel is precharged with a voltage of a polarity equal to that of the gate voltage. Therefore, a writing rate cannot be lowered and hence the display device can display pictures with high picture quality.

It should be further understood by those skilled in the art that although the foregoing description has been made on embodiments of the invention, the invention is not limited thereto and various changes and modifications may be made without departing from the spirit of the invention and the scope of the appended claims.

What is claimed is:

1. A display device, comprising:

(a) a pixels array including a plurality of pixels arranged in a form of a matrix;

(b) a data driver for supplying a tone voltage corresponding to display data to the pixels;

(c) a scan driver for selecting pixels of at least one row to which the tone voltage is to be supplied; and (d) a control circuit for controlling the data driver and the scan driver;

wherein:

(e) the control circuit outputs a first clock signal and the display data to the data driver;

(f) the control circuit outputs to the scan driver a second clock signal, the second clock signal synchronized with the first clock signal and providing a two clock period of a first clock at every n signal creation, by way of not being created every n (n>2) signal creation thereof and outputs a scanning start signal generated a plurality of times during one frame period; and (g) the control circuit outputs to the data driver blanking data other than the display data in place of the display data during a period from the first clock signal of a first creation to a first clock signal of the second creation of the two clock signal period at every n signal creation;

(h) the data driver, in accordance with the first clock signal, sequentially supplies tone voltage corresponding to the display data received from the control circuit and tone voltage in accordance with the blanking data received in place of the display data from the control circuit, to the pixels;

(i) the scan driver, in accordance with the second clock signal, sequentially shifts pixel rows to be selected, and during the period from the first clock signal of the first creation to the first clock signal of the second creation of the two clock signal at every n signal creation, in addition to pixel rows being sequentially shifted, for selecting the other plurality of pixel rows separated from the pixel rows being sequentially shifted by a plurality of rows; and (j) the scan driver, in accordance with the scanning start signal, further repeats a selecting operation of the pixel rows sequentially shifted in accordance with the second clock signal and a selecting operation of the other plurality of pixel rows.

2. A display device according to claim 1, further comprising:

a first memory for keeping the display data therein; and a second memory for keeping the blanking data therein, wherein:

the control circuit reads the display data from the first memory at timing synchronized with the first clock signal, outputs the display data to the data driver, reads from the second memory the blanking data during one clock signal period in the first half of said two clock signal period at every n signal creation, outputs the blanking data to the data driver, and reads from the first memory the display data during the first half of said two clock signal period at every n signal creation and outputs the display data to the data driver.

3. A display device according to claim 1, wherein a period of the first clock signal and a period of the second clock signal are synchronized with a scanning period for the scan driver to select pixels of at least one of the rows of pixels.

4. A display device according to claim 1, wherein:

the scan driver selects during one clock signal period in the first half of said two clock signal period at every n signal creation, the other pixel or (n+1) row.

5. A display device according to claim 1, wherein the control circuit outputs to the scan driver, during one clock signal period in the first half of said two clock signal period at every n signal creation, a scanning enable signal to validate selection of the pixels by the scan driver.

6. A display device according to claim 1, wherein the n is four.

7. A display device according to claim 1, wherein a time distance of signal generation of the scanning start signal is more than one clock signal period of said first clock signal.

* * * * *